United States Patent [19]

Shichi

[11] Patent Number: 4,745,677

[45] Date of Patent: May 24, 1988

[54] METHOD OF MAKING AN ELECTROMAGNETIC INDUCTION APPARATUS

[75] Inventor: Masaru Shichi, Hyogo, Japan

[73] Assignee: Mitsubishi Denki Kabushiki Kaisha, Tokyo, Japan

[21] Appl. No.: 873,142

[22] Filed: Jun. 6, 1986

Related U.S. Application Data

[60] Continuation of Ser. No. 659,137, Oct. 9, 1984, abandoned, which is a division of Ser. No. 475,653, Mar. 15, 1983, abandoned.

[30] Foreign Application Priority Data

Mar. 16, 1982 [JP] Japan ..... 57-43583

[51] Int. Cl.[4] ..... H01F 41/02; H01F 27/10

[52] U.S. Cl. ..... 29/606; 336/58; 336/60; 336/96

[58] Field of Search ..... 264/272.19; 29/602 R, 29/604, 605, 606, 607, 608; 336/55, 57, 58, 60, 92, 94, 96

[56] References Cited

U.S. PATENT DOCUMENTS

| | | | |
|---|---|---|---|
| 2,327,784 | 8/1943 | Hartzell | 336/96 X |
| 2,872,651 | 1/1972 | Treanor | 336/59 X |
| 2,893,061 | 7/1959 | Terry, Jr. | 264/272.19 X |
| 2,914,600 | 11/1959 | Smith et al. | 336/96 X |
| 2,941,905 | 6/1960 | Hofmann | 264/272.19 X |
| 3,201,728 | 8/1965 | McWhinter | 336/60 |
| 3,413,391 | 11/1968 | Carroll et al. | 264/272.19 X |
| 3,634,798 | 1/1972 | Aslteford, Jr. et al. | 336/92 |
| 3,668,583 | 6/1972 | Nichols | 336/60 X |
| 4,145,679 | 3/1979 | Mitchell | 336/58 X |

*Primary Examiner*—Thomas J. Kozma

*Attorney, Agent, or Firm*—Sughrue, Mion, Zinn, Macpeak & Seas

[57] ABSTRACT

An electromagnetic inductor means such as a transformer is improved by reducing the amount of condensable cooling liquid to a level approximating that actually needed to effect cooling; by injecting a resin into spaces between the casing and an insulating container surrounding the sides and bottom of the windings.

3 Claims, 3 Drawing Sheets

METHOD OF MAKING AN ELECTROMAGNETIC INDUCTION APPARATUS

This is a continuation of application Ser. No. 659,137, filed 10-9-84, now abandoned, which is a division of application Ser. No. 475,653 filed 3-15-83, now abandoned.

BACKGROUND OF THE INVENTION

The present invention relates to an electromagnetic induction means having a condensable cooling liquid as a cooling medium. Hereinafter, an explanation will be given in respect of the use of a transformer as such an electromagnetic induction means.

In a transformer of this kind, heated elements such as the iron core, the windings or the like are immersed in a cooling medium so that the heated elements are cooled with the evaporative latent heat of the cooling medium. Hence, the cooling efficiency is high. Furthermore, since mineral oil is not used, the device is non-combustible and non-explosive, the size thereof is small and the weight thereof is light. Thus, a transformer of this kind has many good characteristics, and recently, much attention has been focused thereon.

In the past, there has been known a transformer of this kind as shown in FIG. 1. In FIG. 1, reference numeral 1 denotes an iron core and reference numeral 2 denotes windings which are wound around the iron core 1 and which are composed of a primary winding 2*a* and a secondary winding 2*b*. Reference numeral 3 denotes a duct I between the iron core 1 and the secondary winding 2*b*, and reference numeral 4 denotes a duct II between the primary winding 2*a* and the secondary winding 2*b*.

The inner members of the transformer constituted as described above are stored in a tank 5. A cover 6 is mounted on the upper end of the tank 5 so that the inner members of the transformer are tightly covered by the tank 5 and the cover 6.

There are mounted a primary terminal 7 and a secondary terminal 8 on the side surfaces of the tank 5. Lead wires 9*a*, 9*b*, which are drawn out from the primary winding 2*a* and the secondary winding 2*b*, respectively, are connected thereto. There is provided a cooling means 10 on the cover 6.

A condensable cooling liquid 11 is enclosed in the tank 5. A condensable vapour 12 in the gaseous phase which is caused as the result of the evaporation of the cooling liquid 11 appears in the upper space in the tank 5 and the inner spaces of the cooling means 10.

If the transformer constituted as described above is driven, the windings 2 and the iron core 1 become heating elements, so as to raise the temperature thereof. If the temperature of the windings 2 and the iron core 1 become high, the condensable cooling means 11 is heated so as to evaporate and remove the evaporative latent heat from the windings 2 and the iron core 1, thereby cooling the same. The condensable vapour 12 caused as the result of condensable cooling medium evaporation as mentioned above fills in the upper space of the tank 5 and the inner spaces of the cooling means 10 and is cooled by the cooling means 10, so that the evaporative latent heat is removed from the transformer to result in liquid. The condensable cooling liquid 11, which has thus again become liquid, forms drops which fall downwardly under their own weight.

Since the condensable cooling liquid 11 is enclosed in the tank 5 in a manner such that the elements of the iron core 1 and the windings 2 are immersed therein in accordance with the prior art as mentioned above, the quantity of evaporative cooling liquid 11 is determined by the volume of the tank 5 and the volumes of the windings 2 and the iron core 1. However, the minimum quantity of cooling liquid 11 necessary for cooling the heated elements of the windings 2 and the iron core 1 is determined mainly by the quantity of heat generated by these elements and the quantity of evaporative latent heat of the condensable cooling liquid 11. The minimum quantity of condensable cooling liquid obtained thereby is much smaller than the quantity of the liquid normally enclosed in the tank 5. The price of $C_8F_{16}O$ or the like which is commonly used as the condensable cooling liquid 11 is high, generally several times to about ten times the price of the insulating material which forms the inner members of the transformer. Therefore, the quantity of condensable cooling liquid 11 used was much more than the minimum quantity required for cooling in accordance with the prior art. Hence, there exists a drawback in that the price of the prior transformer is unnecessarily high.

U.S. Pat. No. 4,145,679 to Mitchell discloses an assembly which, as indicated at lines 44-51 includes an inert filler material in the form of a cellular foam or pressboard to minimize the amount of liquid dielectric required. However, the construction disclosed by Mitchell lacks simplicity in design and manufacture and does not allow for any spacing between the outer conductors and the filler if such is desired for cooling. In addition, the filler material in Mitchell must be inserted just prior to introducing the dielectric fluid and cannot be introduced earlier, or simultaneously with other, prior steps because of the effect thereon of subsequent vacuum heating treatments that may desirably be performed on the inductor core, windings and the tank.

SUMMARY OF THE INVENTION

An object of the present invention, achieved in order to remove the above-mentioned drawbacks in accordance with the prior art, is to provide a transformer of low cost by providing an injection resin in a manner so as to fill in the space portion between the windings and the tank and the space portion between the iron core and the tank, in order to reduce the quantity of the condensable cooling liquid, thereby saving the excess cooling liquid to result in the minimum quantity required for cooling.

DETAILED DESCRIPTION OF THE PREFERRED EMBODIMENTS

Figure 1:
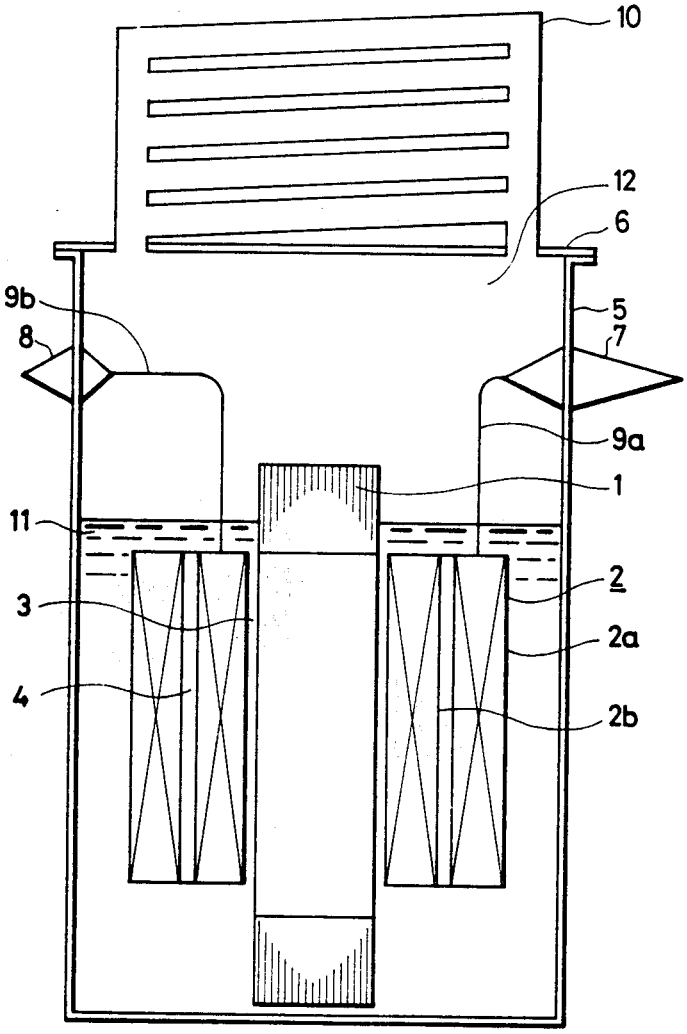
FIG. 1 PRIOR ART
FIG. 1 is a side view in cross section showing a conventional transformer.
Figure 2:
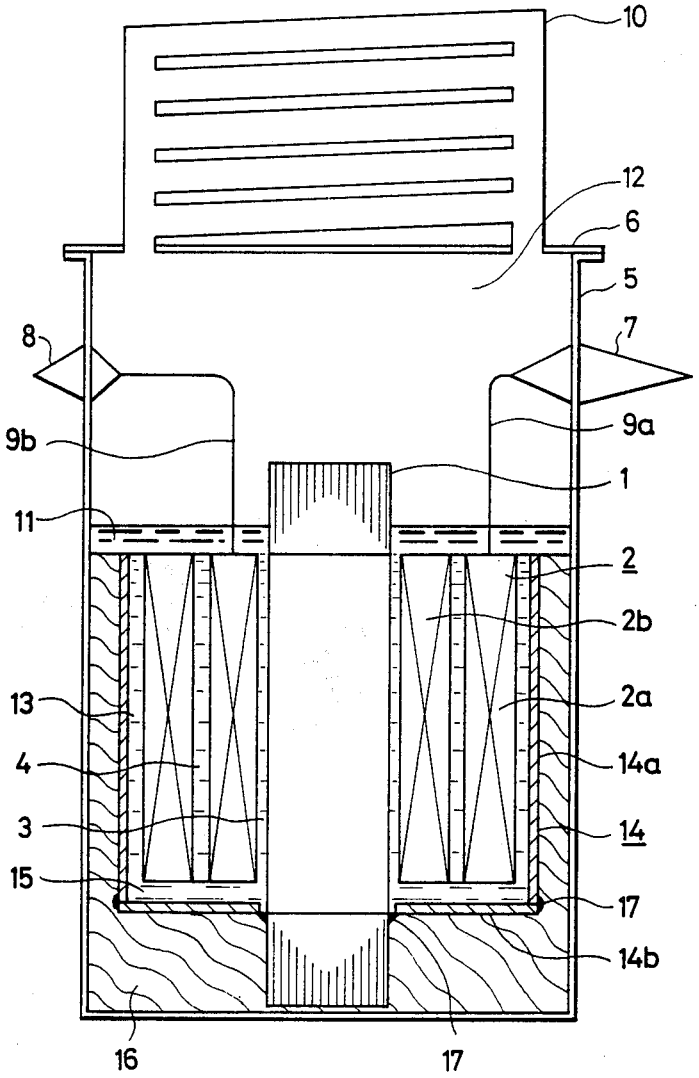
FIG. 2 is a side view in cross section showing one embodiment in accordance with the present invention.

In the following, one embodiment in accordance with the present invention will be explained with reference to FIG. 2. In FIG. 2, reference numerals 1–12 denote members which are the same as those in the prior art shown in FIG. 1. What differs from the prior art is the arrangement wherein a cylindrical portion 14*a* made of insulating material is provided around the primary winding 2*a* with a duct III 13 therebetween. A bottom portion 14*b* made of insulating material is provided at the lower portion of the cylindrical portion 14*a* with a duct IV 15 formed at the lower portion of the winding 2. The insulating portions 14*a* and 14*b* together constitute a container 14, and an injection resin 16 is filled in the space portion formed by the container 14, the iron core 1 and the tank 5. In other words, the condensable cooling liquid 11 is filled in only in the portions necessary for cooling the heated elements of the windings 2 and the iron core 1, that is, in the ducts I–IV 3, 4, 13, 15 and the upper surface portion of the windings 2. Thus, the space portion between the tank 5 and the container 14 is filled with the injection resin 16.

This injection resin 16 is easily filled in accordance with the following method. The inner members of the transformer such as the iron core 1, the windings 2, the container 4 and the like are assembled. In this state, the gap between the iron core 1 and the bottom portion 14*b* and the gap between the cylindrical portion 14*a* and the bottom portion 14*b* are closed with a sealing agent 17, so that the injection resin 16 may not enter portions constituting the duct I 3, the duct II 4, the duct III 13 and the duct IV 15. Then, the assembly is placed in the tank 5. The injection resin 16, which is liquid at normal temperatures, is poured into the space portion formed by the tank 5 and the container 14 to a predetermined quantity, and is then vacuum heated, so that the injection resin 16 becomes hard and rigid.

In general, in order to improve the peak voltage characteristic by removing water components on the iron core 1, the windings 2 and the inner surface of the tank 5 of the transformer, there is employed a method involving the vacuum heating and drying of the same. Hence, heating for hardening the thermosetting injection resin 16 is effected simultaneously with the above vacuum heating and drying treatment.

Figure 3:
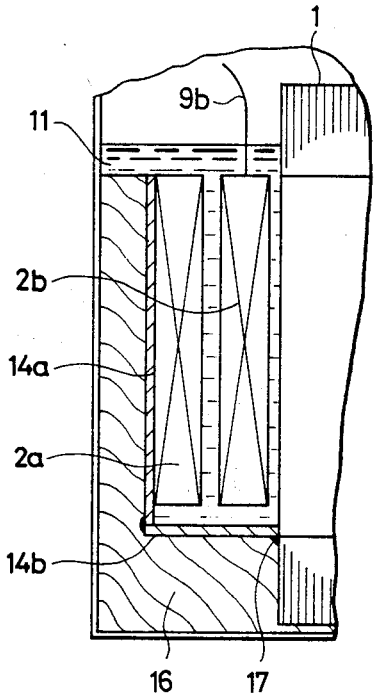
FIG. 3 is a side view in cross section showing another embodiment in accordance with the present invention.

Although the cylindrical portion 14*a* is provided around the winding 2*a* with the duct III 13 therebetween in the above-mentioned embodiment, it is also acceptable if the cylindrical portion 14 is provided directly on the outer periphery of the primary winding 2*a* as shown in FIG. 3. As this cylindrical portion 14*a*, there may be used one obtained by winding an insulating paper (not shown) around the primary winding 2*a*, the effect of which is the same as mentioned above. Hence, the covering of the outer periphery and the lower surface of the winding with insulating material is included in the concept of the container 14.

Although an explanation has been given in respect of a transformer hereinbove, it goes without saying that the same techniques may be applied in respect of a reactor, as well.

In accordance with the present invention as described above, there is provided a container with which the outer periphery and the lower surface of the windings are surrounded and an injection resin is filled in the space portion formed by this container and the tank, thereby making it possible to minimize the quantity of expensive condensable cooling liquid required for cooling the windings and the iron core. Accordingly, it is possible to provide an electromagnetic induction means of lowered cost.

What is claimed is:

1. A method of constructing an electromagnetic induction apparatus of the type having an iron core and primary and secondary windings wound around the iron core and contained in a tank and immersed in a condensable cooling liquid, comprising;

assembling an iron core and primary and secondary windings in a manner so as to form open fluid ducts of passageways (a) between said iron core and the secondary windings, and (b) between said secondary winding and the primary winding;

constructing an insulating container surrounding the outer periphery of said primary winding and a lower portion of both said windings, so as to define the outer walls of a duct or passageway about said primary winding, and so as to form a further duct or passageway communicating with the aforementioned ducts and extending beneath said windings; said container having side walls extending in the longitudinal direction of said windings and terminating at substantially the same vertical level as said windings; placing the assembly in a tank;

injecting a resin into the spaces formed between said container and said tank, to the exterior of said windings and said container, said resin being filled to the same height as the top of said windings and top edges of said container, to define a fluid reservoir having a substantially flat bottom surface defined by said top edges of said container, said tops of said windings, and the top of said resin layer;

solidifying said resin; and filling said tank with a condensable cooling liquid to a level above said windings and the upper ends of said ducts, said condensable cooling liquid being in direct contact with said core in the passageway or duct between said core and said secondary winding.

2. A method as claimed in claim 1, wherein said resin is a thermosetting resin, and including removing water components from said iron core, said windings and inner surfaces of said container by vacuum heating and drying the apparatus after injecting said resin, and simultaneously solidifying said resin via said vacuum heating and drying treatment.

3. A method of constructing an electromagnetic induction apparatus of the type having an iron core and primary and secondary windings wound around the iron core and contained in a tank and immersed in a condensable cooling liquid, comprising:

assembling an iron core and primary and secondary windings in a manner so as to form open fluid ducts or pasageways (a) between said iron core and the secondary winding, and (b) between said secondary winding and the primary winding;

constructing an insulating container surrounding the outer periphery of said primary winding and a lower portion of both said windings so as to form a further duct or passageway communicating with the aforementioned ducts and extending beneath said windings; said container having side walls formed by winding an insulating paper directly onto said primary winding, said container extending in the longitudinal direction of said windings and terminating at substantially the same vertical level as said windings; placing the assembly in a tank;

injecting a resin into the spaces formed between said container and said tank, to the exterior of said windings and said container, said resin being filled to the same height as the top of said windings and top edges of said container, to define a fluid reservoir having a substantially flat bottom surface defined by said top edges of said container, said tops of said windings, and the top of said resin layer;

solidifying said resin; and filling said tank with a condensable cooling liquid to a level above said windings and the upper ends of said ducts, said condensable cooling liquid being in direct contact with said core in the passageway or duct between said core and said secondary winding.

* * * * *